US009249006B2

(12) United States Patent
Tobler

(10) Patent No.: US 9,249,006 B2
(45) Date of Patent: Feb. 2, 2016

(54) MULTI-NOZZLE BEVERAGE DISPENSER WITH SLURRY ICE COOLING SYSTEM

(71) Applicant: Andrew J. Tobler, Geneva, IL (US)

(72) Inventor: Andrew J. Tobler, Geneva, IL (US)

(73) Assignee: Cornelius, Inc., St. Paul, MN (US)

( * ) Notice: Subject to any disclaimer, the term of this patent is extended or adjusted under 35 U.S.C. 154(b) by 131 days.

(21) Appl. No.: 13/870,686

(22) Filed: Apr. 25, 2013

(65) Prior Publication Data

US 2014/0319175 A1 Oct. 30, 2014

(51) Int. Cl.

| | |
|---|---|
| ***B67D 7/80*** | (2010.01) |
| ***B67D 1/08*** | (2006.01) |
| ***F25C 5/18*** | (2006.01) |
| ***F25D 31/00*** | (2006.01) |
| *B67D 1/16* | (2006.01) |
| *B67D 1/00* | (2006.01) |

(52) U.S. Cl.

CPC ..... *B67D 1/0857* (2013.01); *F25C 5/182* (2013.01); *F25D 31/002* (2013.01); *B67D 1/0004* (2013.01); *B67D 1/16* (2013.01)

(58) Field of Classification Search

CPC ..... F25C 5/002; B67D 7/80
USPC ..... 222/108, 196, 386, 146.6, 410
See application file for complete search history.

(56) References Cited

U.S. PATENT DOCUMENTS

| | | | | |
|---|---|---|---|---|
| 4,049,161 | A * | 9/1977 | Kohl | 222/233 |
| 4,139,126 | A * | 2/1979 | Krasner et al. | 222/146.6 |
| 4,335,836 | A | 6/1982 | Harvill | |
| 5,054,654 | A | 10/1991 | Schroeder et al. | |
| 5,535,600 | A | 7/1996 | Mills | |
| 5,732,563 | A | 3/1998 | Bethuy et al. | |
| 6,039,220 | A * | 3/2000 | Jablonski et al. | 222/236 |
| 7,337,618 | B2 | 3/2008 | Wolski et al. | |
| 2008/0141702 | A1* | 6/2008 | Gagliano et al. | 62/389 |
| 2009/0078721 | A1* | 3/2009 | Hoffman et al. | 222/1 |
| 2010/0072225 | A1* | 3/2010 | Sasaki et al. | 222/108 |
| 2010/0140292 | A1* | 6/2010 | Sasaki et al. | 222/64 |
| 2010/0155433 | A1* | 6/2010 | Toyoda et al. | 222/410 |
| 2010/0206900 | A1* | 8/2010 | Dobrusskin et al. | 222/95 |
| 2011/0220681 | A1* | 9/2011 | Paul | 222/129.1 |
| 2011/0220689 | A1* | 9/2011 | Njaastad et al. | 222/639 |
| 2012/0042682 | A1* | 2/2012 | Cominski | 62/389 |
| 2012/0205397 | A1* | 8/2012 | Doelman et al. | 222/105 |
| 2013/0214003 | A1* | 8/2013 | Sevcik et al. | 222/146.6 |

OTHER PUBLICATIONS

International Search Report and Written Opinion, PCT/US2014/021175, date of mailing Aug. 19, 2014.

* cited by examiner

*Primary Examiner* — Donnell Long
(74) *Attorney, Agent, or Firm* — Andrus Intellectual Property Law, LLP

(57) ABSTRACT

A beverage dispenser that uses a slurry ice bath to achieve heat transfer from coils containing a beverage. The invention provides a hopper into which a slurry ice bath is created. The hopper receives ice from an ice bin via an ice chute. The ice bin contains a rotating agitator for pushing ice down the ice bin. Coils containing a beverage to be dispensed are submersed in the slurry ice bath. Ice passing through the ice chute and into the hopper floats to the surface of the water in the hopper. As the agitator rotates, it continues to push ice down the ice chute, which in turn raises the water level of the water in the hopper. The water level then reaches an equilibrium level, where the buoyant force of the ice in the water will prevent additional ice from falling through the ice chute.

11 Claims, 2 Drawing Sheets

MULTI-NOZZLE BEVERAGE DISPENSER WITH SLURRY ICE COOLING SYSTEM

FIELD OF THE INVENTION

The present invention relates generally to the field of beverage dispensers and more particularly to a more efficient approach to achieving the heat transfer requirements of beverage products.

DESCRIPTION OF THE PRIOR ART

Refrigerated beverage dispensers are used to control the temperature at which beverages are dispensed. Prior art devices use heat transfer schemes that consist of a cold plate or a mechanical refrigeration ice bank.

For dispensers using a cold plate system, it is common to have store personnel load ice into the machine. The ice is then used as the heat transfer medium to absorb heat from the cold plate and subsiding tubes that contain the beverage. These systems typically require electricity for moving ice to achieve proper cold plate coverage.

In dispensers using a mechanical refrigeration system, an "ice bank" is created via a refrigeration system. The ice bank of a particular size and mass is used in conjunction with cooling tubes containing product to be dispensed. These tubes typically reside in a water bath that contains the refrigeration-created ice bank. Dispensers using this refrigeration technique typically require electricity and specialized components for operating the refrigeration system.

It would be extremely advantageous to have a refrigerated beverage dispenser that dispenses refrigerated beverages more efficiently and at a reduced cost by reducing the number of electric components and by reducing the amount of electricity required to chill the beverage.

SUMMARY OF THE INVENTION

The present invention relates to a beverage dispenser that uses a slurry ice bath to achieve heat transfer from coils containing a beverage. This results in a more efficient and lower cost solution for controlling the temperature of a beverage to be dispensed. The more cost effective heat transfer approach of the present invention can be achieved by replacing the cold plate or refrigeration system of prior art beverage dispensers with a slurry ice bath. The invention generally provides a hopper into which a slurry ice bath is created. The hopper receives ice from an ice bin via an ice chute. The ice chute can be curved to prevent water from splashing up the chute as ice drops into the hopper. This allows the ice bin to optionally be used to dispense ice for consumption without the risk of contamination. The ice bin contains a rotating agitator for pushing ice down the ice bin. As the ice collects in the hopper, it forms a slurry ice bath. Coils containing a beverage to be dispensed are submersed in the slurry ice bath. The slurry ice causes heat to transfer from the coils thereby maintaining the coils at a predetermined temperature. The system can also have an optional recirculation pump, and temperature monitoring. Ice passing through the ice chute and into the hopper floats to the surface of the water in the hopper. As the agitator rotates, it continues to push ice down the ice chute, which in turn raises the water level of the water in the hopper. The water level then reaches an equilibrium level, where the buoyant force of the ice in the water will prevent additional ice from falling through the ice chute. In this way, the beverage dispenser regulates the flow of ice into the hopper without the need for additional mechanical or electrical components.

DESCRIPTION OF THE FIGURES

Attention is now directed to drawings that illustrate the features of the present invention.

Several drawings and illustrations have been presented to aid in understanding the present invention. The scope of the present invention is not limited to what is shown in the figures.

DETAILED DESCRIPTION OF THE PREFERRED EMBODIMENT

Figure 1:
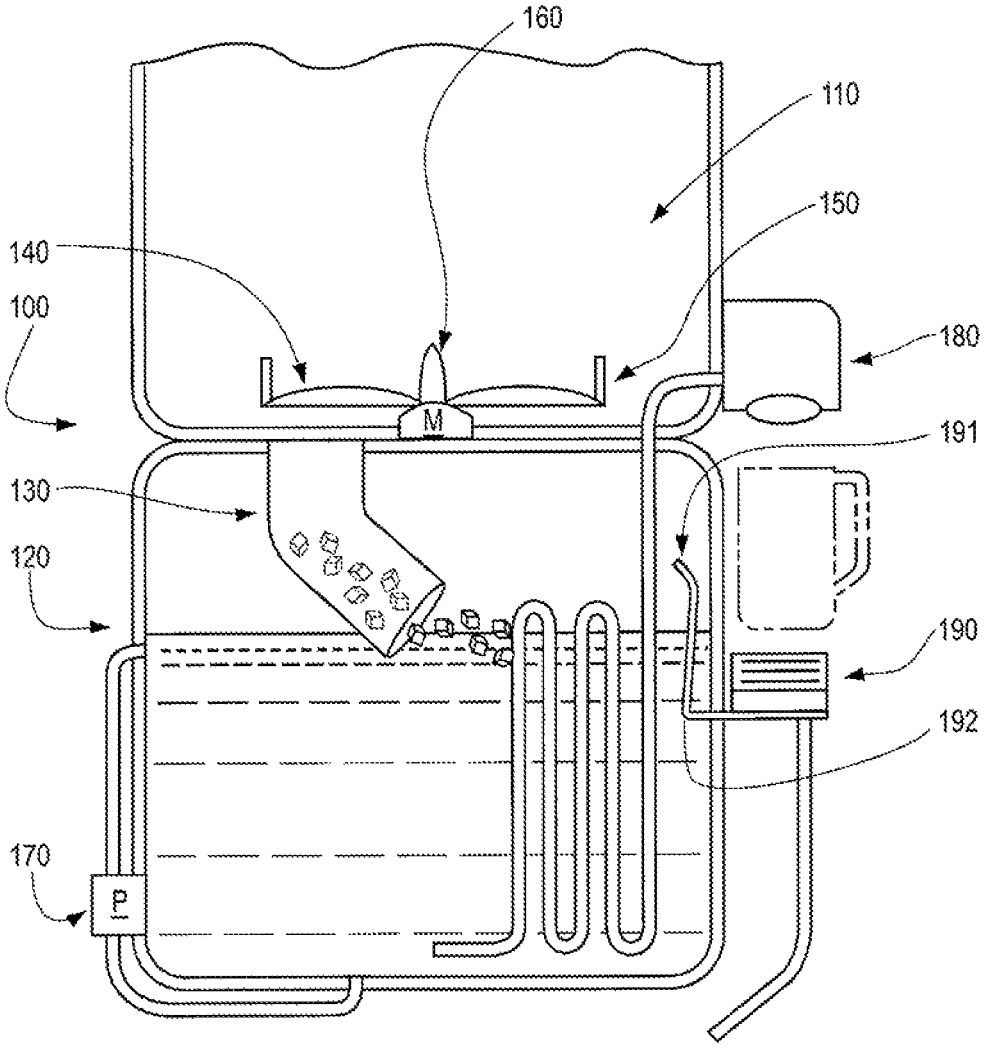
FIG. 1 shows a schematic view of a beverage dispenser according to the present invention.

FIG. 1 shows a schematic view of a beverage dispenser 100 according to the present invention. The beverage dispenser 100 includes an ice bin 110 and a hopper 120. The ice bin 110 and the hopper 120 are in fluid communication via an ice chute 130, which extends from the bottom of the ice bin 110 into the hopper 120. The ice bin 110 and the hopper 120 may be manufactured using a rotational molding process thereby reducing manufacturing build time, or by any other manufacturing process. By using a rotational molded plastic, one may eliminate the need for welding. The ice bin 110 and hopper 120 may thus be modular, but can also be integrally formed. Moreover, the ice bin 110 and hopper 120 may be foamed, or otherwise insulated, into their hollow cavity, thereby providing insulating properties and preventing condensation from forming.

The ice bin 110 contains an agitator 140 which rotates in the ice bin 110. The ice bin 110 may also contain a mount for an optional ice maker. The mount may further contain a molded-in drain for draining any excess water from the ice maker to the hopper 120. An ice maker is not required because the ice bin 110 can also be manually loaded.

The agitator 140 is secured to a motor for rotating the agitator 140. Within the ice bin 110, the agitator 140 rotates over the ice chute 130. Thus, when the ice bin 110 is filled with ice, the agitator 140 forces ice down the ice chute 130 and into the hopper 120. In operation, the hopper 120 is filled with water, which forms a slurry ice bath as ice moves from the ice bin 110 into the hopper 120. In a preferred embodiment, the ice chute 130 is curved, or angled, to prevent water from splashing up the ice chute 130 as ice drops into the hopper 120. Preventing water from splashing up the ice chute 130 provides the advantage of reducing potential contamination of the ice bin 110 with water from the hopper 120. As such, the ice bin 110 can further be used to dispense ice for consumption without the risk of contamination.

The ice passing through the ice chute 130 and into the hopper 120 floats to the surface of the water in the hopper 120. As the agitator 140 rotates, it continues to push ice down the ice chute 130, which in turn raises the water level of the water in the hopper 120. The water level then reaches an equilibrium level, where the buoyant force of the ice in the water will prevent additional ice from falling through the ice chute 130. At the equilibrium level, the buoyant upward force of the ice in the water is equal to the force of gravity on the ice in the chute, and no additional ice flows into the hopper 120. In this way, the beverage dispenser 100 regulates the flow of ice into the hopper 120 without the need for additional mechanical or electrical components.

Figure 3:
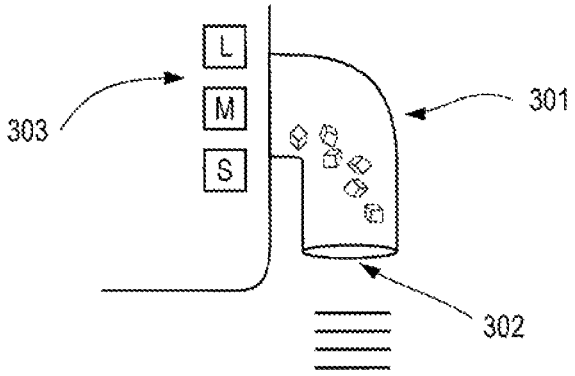
FIG. 3 shows an isolated ice dispenser.

In an embodiment of the invention, the agitator 140 comprises at least one break bar 150 and an agitator cone 160, as seen in FIG. 3. A problem that can occur in the ice bin 110 is that individual pieces of ice may melt and fuse together, thus forming a large block of ice. Large blocks of ice are undesirable in the ice bin 110, because they cannot fit through the ice chute 130 or be dispensed for use in a beverage. Therefore, one embodiment of the invention provides for at least one break bar 150 that prevents large ice blocks from forming as the agitator 140 rotates.

An additional problem that can occur when the agitator 140 rotates beneath a large volume of ice is that the ice can form a large solid cylinder above the agitator's 140 center of rotation. The invention provides for an agitator cone 160 placed at the center of the agitator 140. The agitator cone 160 forces ice away from the center of rotation, thereby preventing the build-up of ice on the center of the agitator 140. Moreover, the agitator cone 160 may optionally be used to fasten the agitator 140 to the motor.

The ice bin 110 may have a swinging door which opens to allow operators of the beverage device to load further ice into the ice bin 110. The swinging door may have an electronic display for displaying customer orders attached to it. Alternatively, the ice bin 110 may contain an ice maker connected to a water source to eliminate the need for manually refilling the ice bin 110. Typically, when the ice maker finishes an ice making cycle, any unused water is discarded. The present invention contemplates that the ice maker may drain through a tube into the hopper 120 so that the unused water may be added to the slurry ice bath, rather than wasting the unused water.

The ice bin 110 further can have at least one ice dispenser connected to it. FIG. 3 shows an exemplary ice dispenser connected to the ice bin 110. The ice dispenser includes a dispenser chute 301 that draws ice from the ice bin 110 and dispenses the ice into a beverage container when a dispensing gate 302 is opened. More specifically, the dispenser chute 301 receives ice from the ice bin 110 as the agitator 140 rotates, thereby pushing ice to the ice dispenser. The dispensing gate 302 may be opened by activating a button 303 on the ice dispenser. For example, the ice dispenser may include a button 303 to dispense ice for a large beverage, medium beverage, or small beverage. Depending on the size of the beverage selected, the dispensing gate 302 will swing or retract to an open position for a predetermined time interval and dispense a predetermined portion of ice.

The timing of the opening and closing of the dispense gate 302 is controlled by a microprocessor. The microprocessor may also control the activation of the agitator 140. For example, the agitator 140 may rotate for five seconds when a button 303 is activated. By rotating for five seconds each time a button 303 is activated, the agitator ensures that the dispenser chute 301 refills with ice so that it may dispense ice again the next time a button 303 is activated. The duration over which the agitator is activated will vary with the size of the ice bin 110, the size of the agitator 140, and the dispensing requirements. The ice dispenser should remain full at all times in order to quickly deliver a portion of ice. If the ice chute becomes depleted, and a button pushed, then the amount of ice dispensed would be less than the amount required for a beverage.

Additionally, the microprocessor may also activate the agitator 140 in regular intervals to deliver ice from the ice bin 110 to the hopper 120. For example, the agitator may be off for 30 minutes, and then on for 5 seconds, to keep the ice "loose" and prevent clumping. This time-based feature could supplement activation of the agitator in response to the pressing of a button 303. Activating the agitator 140 in regular intervals eliminates the need for the agitator 140 to be in constant rotation, thereby saving energy and reducing the wearing down of parts. Optionally, the microprocessor may also receive a signal from a temperature sensor indicating the temperature of the slurry ice bath. If the temperature drops below a certain level, the microprocessor may then activate the agitator 140 to force additional ice into the hopper 120. An example of such a processor is described in paragraphs [0005], [0006], and [0033] of Published U.S. Pat. Application number 2011/0049190, which is hereby incorporated by reference in its entirety.

Returning to FIG. 1, the hopper 120 contains a recirculation device such as a recirculation pump 170, to ensure an even heat distribution on the slurry ice bath. The recirculation pump 170 may circulate water from the top of the slurry ice bath to the bottom (or vice-versa). As such, the recirculation pump 170 helps prevent a temperature gradient from forming in the slurry ice bath.

The hopper 120 also contains a temperature sensor for measuring the temperature of the slurry ice bath. The temperature sensor may be connected to an LED light, or other alert mechanism, for alerting an operator if the temperature of the slurry ice bath exceeds a desired range. As discussed above, the temperature sensor may also be connected to a microprocessor controlling the agitator 140.

The hopper 120 further contains coils carrying beverage. In operation, the coils are submersed in the slurry ice bath, which cools the beverage flowing through the coils. Each coil is attached to a beverage source on one end, and to a dispense valve 180 on the other end. The beverage source may be a syrup, water, carbonated water, or other beverage or beverage component. As seen in top-down perspective in FIG. 2, the beverage dispenser 100 preferably contains two sets of dispense valves 180, where the first set 201 is placed at a 90 degree angle from the second set 202. Placing two sets of valves 90 degrees apart optimizes the space used by the beverage dispenser 100 and creates two work stations from which operators may dispense beverages. Each set 201 and 202 contains dispense valves 180, and at least one ice dispenser chute 301.

Figure 2:
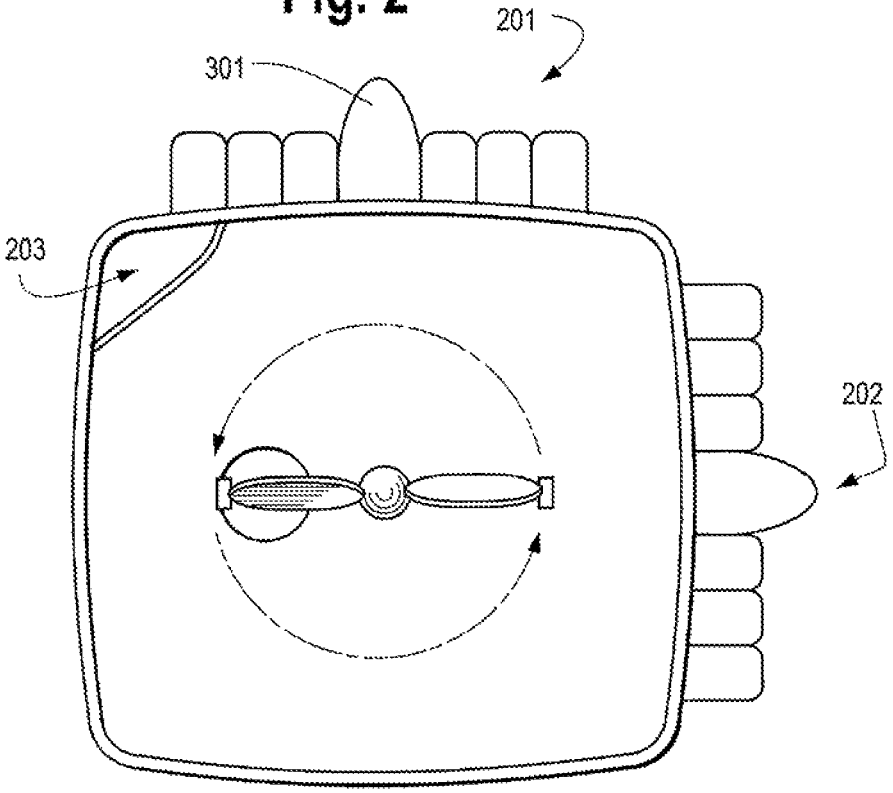
FIG. 2 shows, from a top-down perspective, a beverage dispenser having two sets of dispensers.

Furthermore, FIG. 2 shows a plumbing compartment 203 in one corner of the ice bin. The plumbing compartment 203 is a hollow compartment in which plumbing lines may be placed. The plumbing compartment 203 may extend downward and through the hopper 120. Plumbing lines such as water, drain overflow, and other lines commonly used for plumbing may be positioned within the plumbing compartment 203. Traditional beverage dispensers require plumbing lines, but do not provide a plumbing compartment 203, thus requiring the plumbing lines to be run externally. External plumbing lines can become unwieldy and unattractive.

Returning to FIG. 1, the distance between the water level in the hopper 120 and the dispense valves 180 is preferably minimized. This minimizes the portion of the coil that is exposed between the water level and the valve. In other words, it is preferable to maximize the portion of the coil that is submersed in the slurry ice bath. Beverage contained in an exposed portion of a coil will warm to room temperature and will affect the temperature of a dispensed beverage.

It is also preferable to release the overflow from the slurry ice bath into a drip tray 190 placed below the dispense valve 180*s*. The drip tray 190 must be spaced far enough below the dispense valve 180*s* to allow cups to fit between the drip tray

190 and the dispense valve 180. Moreover, the drip tray 190 is connected to a plumbing line for draining overflow. In an embodiment having two sets of dispense valve 180*s* set 90 degrees apart, it is preferable to install a shared drip tray 190 that extends below both sets of dispense valve 180*s*. A shared drip tray 190 has the advantage of requiring only one plumbing line for releasing overflow.

Because the water level of the slurry ice bath is preferably maintained close to the height of the dispense valve 180, it is beneficial to install an overflow drain in the hopper 120 that drains down to the drip tray 190. One embodiment of the invention therefore includes an internal dam as seen in FIG. 2. Specifically, the internal dam includes a dam wall 191, and a drain release 192. The height of the dam wall 191 allows the water level of the slurry ice bath to approach the height of the dispense valve 180*s*. The drain release 192 is positioned in the drip tray 190.

Each dispense valve 180 can be connected to at least one coil for dispensing beverage. In addition, a dispense valve 180 may optionally be further connected to a coil containing water, carbonated water, or a flavor shot. The water, carbonated water, or flavor shot may be mixed in the dispense valve 180 to create a desired beverage. Post-mix valves may be used to mix multiple steams in the nozzle.

Several descriptions and illustrations have been provided to aid in understanding the present invention. One with skill in the art will realize that numerous changes and variations may be made without departing from the spirit of the invention. Each of these changes and variations is within the scope of the present invention.

I claim:

1. A beverage dispenser for dispensing beverages, comprising:

an ice bin that contains ice and is positioned above a hopper that contains water;

a chute having at least one opening in the ice bin and one opening in the hopper, the chute connecting the ice bin and the hopper;

an agitator mounted within the ice bin, where the agitator is adapted to rotate at least in part over the opening of the chute in the ice bin to cause ice from the ice bin to fall into the water in the hopper and form a slurry ice bath;

at least one tube adapted to carry a beverage, the tube having a coiled portion positioned in the slurry ice bath in the hopper and an end portion connected to a dispense valve for dispensing the beverage;

wherein the ice bin, hopper and chute are configured such that a buoyant upward force of the ice in the water, at equilibrium, prevents ice from flowing into the hopper via the chute to thereby regulate flow of ice into the hopper without additional mechanical or electrical components.

2. The beverage dispenser of claim 1, further comprising a cone mounted on the center of the agitator.

3. The beverage dispenser of claim 1, further comprising at least one bar mounted on the agitator.

4. The beverage dispenser of claim 1, further comprising a first and second set of dispense valves connected to the beverage dispenser, wherein the first set of dispense valves is positioned approximately perpendicular to the second set of dispense valves.

5. The beverage dispenser of claim 4, further comprising a drip tray extending below both the first set of dispense valves and the second set of dispense valves, the drip tray having a single plumbing line.

6. The beverage dispenser of claim 1, further comprising a drip tray positioned below the dispense valve.

7. The beverage dispenser of claim 1, the hopper further comprising an internal dam, the internal dam having a dam wall and a drain opening, wherein the drain opening is positioned in a drip tray attached to the beverage dispenser.

8. The beverage dispenser of claim 1, further comprising at least one ice dispenser, wherein the ice dispenser is affixed to the exterior of the beverage dispenser and is adapted to receive ice pushed into the ice dispenser by the agitator.

9. The beverage dispenser of claim 1, wherein the chute is configured to prevent water from splashing up the chute as ice drops into the hopper.

10. The beverage dispenser of claim 1, comprising a temperature sensor that senses a temperature of the slurry ice bath.

11. The beverage dispenser of claim 10, wherein the temperature sensor is connected to an alert mechanism that alerts an operator if the temperature of the slurry ice bath exceeds a range.

* * * * *